US008596197B2

(12) United States Patent
Doucet et al.

(10) Patent No.: US 8,596,197 B2
(45) Date of Patent: Dec. 3, 2013

(54) PRINTING PRESS CYLINDER ASSEMBLY AND METHOD OF INSTALLING SLEEVES ON A MANDREL OF A PRINTING PRESS CYLINDER ASSEMBLY

(75) Inventors: Louis John Doucet, Salem, NH (US); Daniel Paul Gagne, South Berwick, ME (US); James Brian Vrotacoe, Barrington, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 13/154,984

(22) Filed: Jun. 7, 2011

(65) Prior Publication Data

US 2012/0312181 A1 Dec. 13, 2012

(51) Int. Cl.
*B41F 27/12* (2006.01)
*B41F 27/14* (2006.01)

(52) U.S. Cl.
USPC ..... 101/375; 101/376; 101/479

(58) Field of Classification Search
USPC ..... 101/375, 376, 378, 382.1, 479; 492/4; 29/895.23
See application file for complete search history.

(56) References Cited

U.S. PATENT DOCUMENTS 5,706,731 A 1/1998 Francille et al.
5,904,095 A * 5/1999 Nelson ..... 101/375
6,283,026 B1 9/2001 Tocheport et al.
6,360,662 B1 3/2002 Busshoff
6,401,613 B1 6/2002 Gayle et al.
6,782,821 B2 8/2004 Dilling et al.
2005/0257706 A1 11/2005 Simon et al.
2005/0257707 A1 11/2005 Re et al.
2008/0173196 A1 7/2008 Iwamoto et al.

FOREIGN PATENT DOCUMENTS

FR 2789626 A1 8/2000
WO WO 2004/018210 A1 3/2004

* cited by examiner

*Primary Examiner* — Matthew G Marini
*Assistant Examiner* — Justin Olamit
(74) *Attorney, Agent, or Firm* — Davidson, Davidson & Kappel, LLC

(57) ABSTRACT

A printing press cylinder assembly is provided including a mandrel including an outer surface, a passage formed therein, at least one first conduit formed therein coupled to the passage and the outer surface, and at least one second conduit formed therein coupled to the passage and the outer surface. The printing press cylinder assembly also includes a guide piece located in the passage. The guide piece is movable in the passage between a first position where the guide piece guides air from the passage to the at least one first conduit and a second position where the guide piece guides air from the passage to the at least one second conduit. A method of installing a bridge sleeve and an outer sleeve on a mandrel of a printing cylinder assembly is also provided.

16 Claims, 3 Drawing Sheets

PRINTING PRESS CYLINDER ASSEMBLY AND METHOD OF INSTALLING SLEEVES ON A MANDREL OF A PRINTING PRESS CYLINDER ASSEMBLY

The present invention relates generally to printing presses and more specifically to a method and apparatus for providing air to sleeves mounted on cylinders.

BACKGROUND OF INVENTION

U.S. Pub. No. 2005/0257706 discloses an interchangeable printing cylinder including a cylindrical shaft, a sleeve supported on the shaft and a tube, whose face constitutes the active surface of the cylinder, received on the sleeve. The shaft includes therein a longitudinal channel and five radial conduits, with each conduit leading to one of five radial conduits formed in the sleeve. The radial conduits in the sleeve receive pressurized air from the radial conduits in the shaft and conduct the pressurized air between an internal surface of the tube and an external surface of the sleeve. In one embodiment, a valve is included between the radial conduits in the shaft and the radial conduits in the sleeve. The valve makes it possible to direct the flow pressurized air coming from the conduits either between the sleeve and the cover or between the tube and the sleeve.

BRIEF SUMMARY OF THE INVENTION

A printing press cylinder assembly is provided including a mandrel including an outer surface, a passage formed therein, at least one first conduit formed therein coupled to the passage and the outer surface, and at least one second conduit formed therein coupled to the passage and the outer surface. The printing press cylinder assembly also includes a guide piece located in the passage. The guide piece is movable in the passage between a first position where the guide piece guides air from the passage to the at least one first conduit and a second position where the guide piece guides air from the passage to the at least one second conduit.

A method of installing a bridge sleeve and an outer sleeve on a mandrel of a printing cylinder assembly is also provided. The method includes providing a guide piece in a passage inside the mandrel, setting the guide piece in a first position and supplying air into the passage such that the air flows into at least one first conduit to an outer surface of the mandrel, sliding the bridge sleeve onto the mandrel, moving the guide piece into a second position and supplying air into the passage such that the air flows into at least one second conduit to an outer surface of the bridge sleeve and sliding the outer sleeve onto the bridge sleeve.

BRIEF DESCRIPTION OF THE DRAWINGS

The present invention is described below by reference to the following drawings, in which.

DETAILED DESCRIPTION

Figure 1:
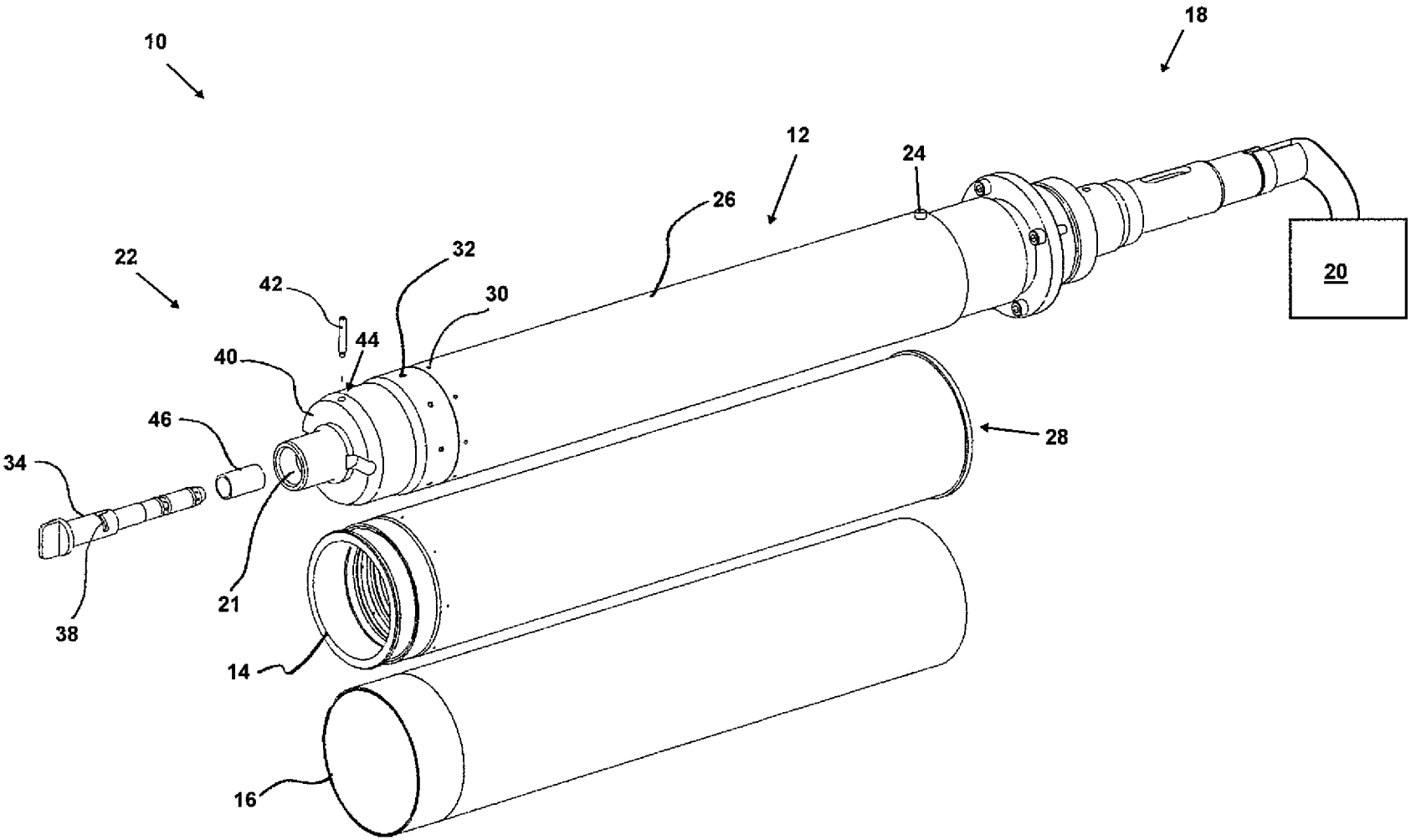
FIG. 1 shows an exploded perspective view of a printing press cylinder assembly according to an embodiment of the present invention.

FIG. 1 shows an exploded perspective view of a printing press cylinder assembly 10 according to an embodiment of the present invention. Cylinder assembly 10 includes a mandrel 12 and a removable bridge sleeve 14 which may be slid onto an outer surface of mandrel 12. A removable outer sleeve 16, which in this embodiment is a blanket sleeve, is also included for sliding onto an outer surface of bridge sleeve 14. In alternative embodiments, outer sleeve 16 may be a tubular printing plate. On a first or drive side 18 of printing press cylinder assembly 10, an air source 20 may provide pressurized air into an axially aligned passage 21 (FIG. 2) extending through an interior of mandrel 12. Passage 21 may extend all the way from drive side 18 to a second or work side 22 of printing press cylinder assembly 10. Mandrel 12 may include a stop 24, preferably in the form of a pin protruding from an outer mounting surface 26, for stopping bridge sleeve 14 as bridge sleeve 14 is slid axially onto mandrel 12. Mandrel 12 also includes a plurality of first radial conduits 30 formed therein near work side 22 and a plurality of second radial conduits 32 formed therein spaced an axial distance D1 (FIG. 2) from first radial conduits 30. First radial conduits 30 and second radial conduits 32 extend from passage 21 radially outward to outer mounting surface 26. In the embodiment shown in FIGS. 1 to 4, mandrel 12 includes eight first conduits 30 and eight conduits 32; however, in other embodiments, the number of conduits 30, 32 may each be more or less than eight and do not have to be equal in number to each other.

In order to selectively couple air source 20, via passage 21 inside of mandrel 12, to either first conduits 30 or second conduits 32, a guide piece 34 is provided in passage 21 at a valve end 40 of mandrel 14, which is at work side 22 of cylinder assembly 10. Guide piece 34 is configured to (a) block air from flowing into first conduits 30 and direct air into second conduits 32 or (b) block air from flowing into second conduits 32 and direct air into first conduits 30. In the preferred embodiment shown in FIGS. 1 to 4, guide piece 34 is configured as a two position spool valve. Guide piece 34 allows for a single air supply, provided here by air source 20 through passage 21 in mandrel 12, to accommodate independent removal/installation of bridge sleeve 14 and outer sleeve 16. Guide piece 34 may be provided with a circumferentially extending valve retention groove 38 on an outer surface of guide 34, which receives a fastener 42, in the form of a set screw, passing through a radial hole 44 in mandrel 12 to hold guide piece in passage 21. A resilient element 46, in the form of a compression spring, forces guide piece 34 axially away from mandrel 12 towards work side 22 to press valve retention groove 38 against fastener 42.

Figure 2:
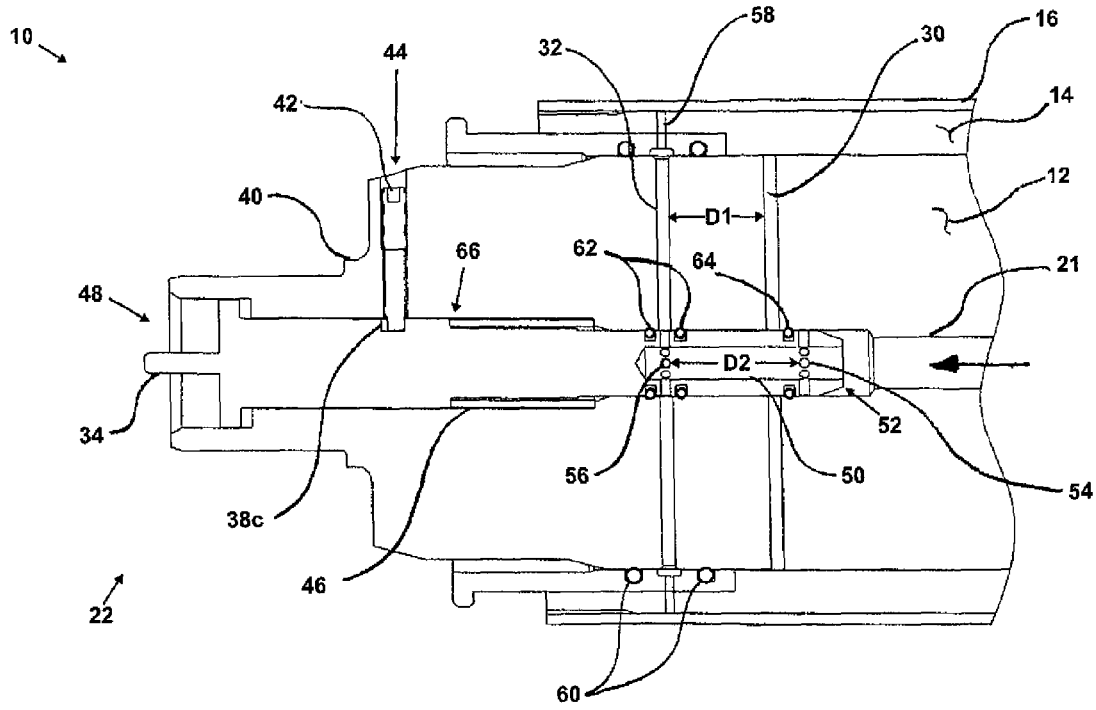
FIGS. 2 and 3 show a longitudinal cross-sectional view of the printing press cylinder assembly with a guide piece of the printing press cylinder assembly inserted into a passage in a mandrel of the printing press cylinder assembly.
Figure 3:
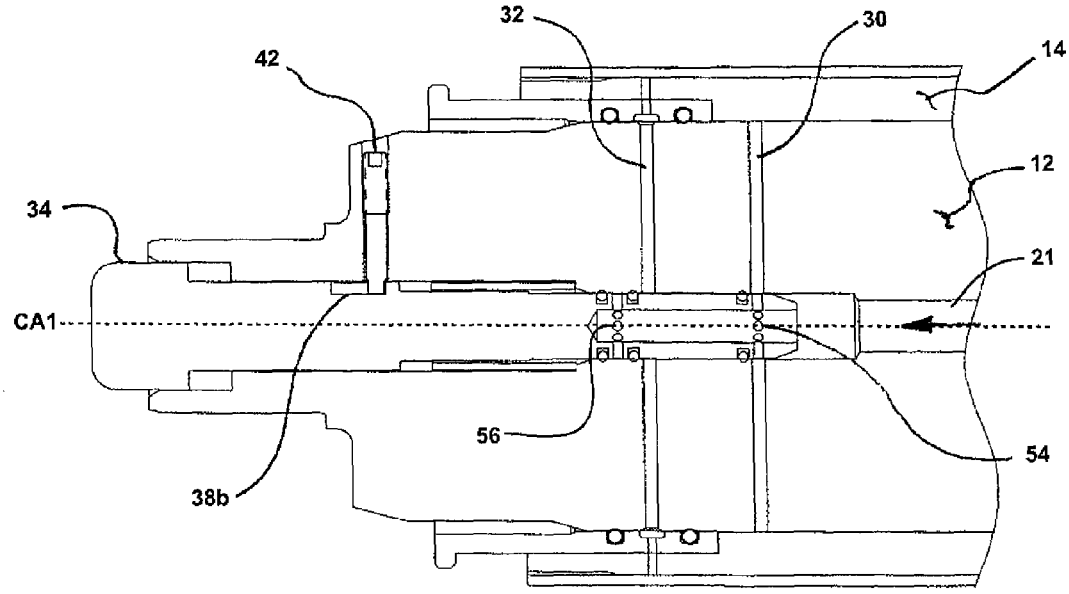

FIGS. 2 and 3 show a longitudinal cross-sectional view of printing press cylinder assembly 10 with guide piece 34 inserted into passage 21. In FIG. 2, guide piece 34 is selectively positioned to block air from flowing from passage 21 into first conduits 30 and direct air into second conduits 32, which allows outer sleeve 16 to be slid off or onto bridge sleeve 14 (i.e., outer sleeve 16 installation/removal position). In FIG. 3, guide piece 34 is selectively positioned to block air from flowing from passage 21 into second conduits 32 and direct air into first conduits 30, which allows bridge outer sleeve 14 to be slid off or onto mandrel 12 (i.e., bridge sleeve 14 installation/removal position). Set screw 42 is holding guide piece 34 in position as compression spring 46 provides constant force against guide piece 34 to keep guide piece 34 in position against set screw 42.

Guide piece 34 includes an axial cavity 50 formed therein at a head end 52 thereof and eight first radial holes 54 connected to axial cavity 50. Guide piece 34 also includes eight second radial holes 56 formed therein which are spaced from first radial holes 54 by an axial distance D2, which is greater than distance D1. First radial holes 54 are configured to connect axial cavity 50 to first radial conduits 30 when guide piece 34 is in the bridge sleeve installation/removal position shown in FIG. 3, allowing air to flow from passage 21 through axial cavity 50 and first radial holes 54 into first radial conduits 30. In the position shown in FIG. 3, air flowing into first radial conduits 30 creates an air cushion between the outer surface of mandrel 12 and the inner surface of bridge sleeve 14, allowing for bridge sleeve 14 to be slid off of mandrel 12.

Similarly, second radial holes 56 are configured to connect axial cavity 50 to second radial conduits 32 when guide piece 34 is in the outer sleeve 16 installation/removal position shown in FIG. 2, allowing air to flow from passage 21 through axial cavity 50 and second radial holes 56 into second radial conduits 32. Bridge sleeve 14 also includes a plurality of radial bridge holes 58 formed therein that align with second radial conduits 32 formed in mandrel 12. In the position shown in FIG. 2, air flowing into second radial conduits 32 enters into radial bridge holes 58 and creates an air cushion between the outer surface of bridge sleeve 14 and the inner surface of outer sleeve 16, allowing for outer sleeve 16 to be slid off of bridge sleeve 14.

O-rings 60 may be provided on the inner surface of bridge sleeve 14 on opposite sides of radial bridge holes 58 to isolate radial bridge holes 58 and second radial conduits 32 utilized for the installation/removal of outer sleeve 16. Additional o-rings 62 may also be provided on opposite sides of second radial holes 56 to seal the connections between second radial holes 56 and second conduits 32 and o-rings 64 may be provided on the downstream side of first radial holes 54 to prevent air from leaking into second conduits 32 in the bridge sleeve 14 installation/removal position and to prevent air from leaking into first conduits 30 in the outer sleeve 16 installation/removal position.

Figure 4:
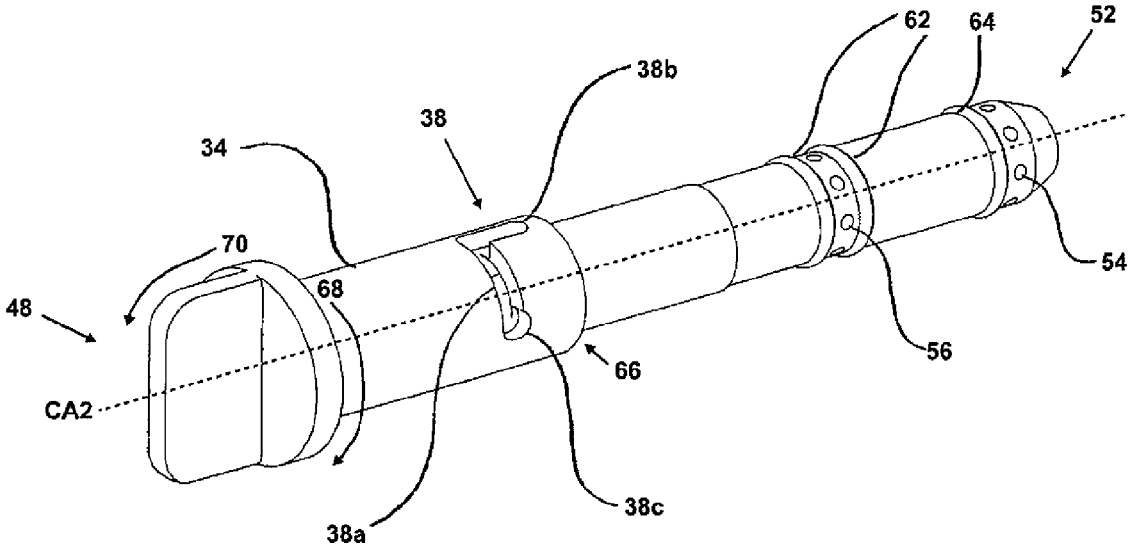
FIG. 4 shows a detailed view of the guide piece.

FIG. 4 shows a detailed view of guide piece 34, illustrating the spacing of first and second radial holes 54, 56. Guide piece 34 may be beveled at head end 52 for ease of insertion into passage 21 and may be flat at a handle end 48 thereof to aid in turning. Valve retention groove 38 includes a circumferentially aligned portion 38*a* and two axially aligned portions 38*b*, 38*c* extending from circumferentially aligned portion 38*a* toward head end 52, with portion 38*b* extending further towards head end than portion 38*c*. As shown in FIG. 4, guide piece 34 may include a step 66 between valve retention groove 38 and second radial holes 56, where guide piece 34 gets radially wider to provide a surface for compression spring 46 to contact.

Referring to FIGS. 2 to 4, to switch between the outer sleeve 16 installation/removal position shown in FIG. 2 and the bridge sleeve 14 installation/removal position shown in FIG. 3, guide piece 34 only needs to be rotated ninety degrees manually by an operator of press cylinder assembly 10. Beginning in the outer sleeve 16 installation/removal position shown in FIG. 2, with set screw in axially aligned portion 38*c*, the operator may slightly press guide piece 34 towards drive side 18 (FIG. 1) to overcome the force of compression spring 46 and bring circumferentially aligned portion 38*a* into contact with set screw 42, then turn handle end 48 in a first direction 68 (e.g., clockwise). Once set screw 42 is aligned with axially aligned portion 38*b*, compression spring 46 forces guide piece 34 towards work side 22 and set screw 42 enters into contact with the edge of axially aligned portion 38*b*, setting guide piece 34 in the bridge sleeve 14 installation/removal position shown in FIG. 3. From this position, to enter back into the outer sleeve 16 installation/removal position shown in FIG. 2, the operator may press guide piece 34 towards drive side 18 (FIG. 1) to overcome the force of compression spring 46 and bring circumferentially aligned portion 38*a* into contact with set screw 42, then turn handle end 48 in a second direction 70 (e.g., counterclockwise). Once set screw 42 is aligned with axially aligned portion 38*c*, compression spring 46 forces guide piece 34 towards work side 22 and set screw 42 enters into contact with the edge of axially aligned portion 38*c*, setting guide piece 34 back into the outer sleeve 16 installation/removal position shown in FIG. 2.

The embodiment of printing press cylinder assembly 10 disclosed herein may allow for easy installation and removal of both bridge sleeve 14 and outer sleeve 16 using a single air source 20 and passage 21. To effect a plate or blanket change, guide piece 34 may be set in the outer sleeve 16 installation/removal position and air may be provided from air source 20 through passage 21, axial cavity 50, second radial holes 56, second radial conduits 32 and radial bridge holes 58 to between the outer surface of bridge sleeve 14 and the inner surface of outer sleeve 16. Outer sleeve 16, which may be a tubular blanket or printing plate, is then slid off of bridge sleeve 14. If a next print job requires a tubular blanket or printing plate of the same inner diameter as outer sleeve 16, guide piece 34 is kept in the outer sleeve installation/removal position and a new outer sleeve is slid onto bridge sleeve 14 while air is provided to the outer surface of bridge sleeve 14. If the next print job requires a tubular blanket or printing plate having a larger or smaller inner diameter than outer sleeve 16, guide piece 34, which is easily accessible to the operator because of its placement at the axial end of assembly 10 at work side 22, is easily rotated into the bridge sleeve 14 installation/ removal position and bridge sleeve 14 is removed and replaced with a new bridge sleeve having a larger or smaller diameter than bridge sleeve 14 by sliding the new bridge sleeve onto mandrel 12 while air is provided from air source 20 through passage 21, axial cavity 50, first radial holes 54 and first radial conduits 30 to the outer surface of mandrel 12. After the new bridge sleeve is mounted onto mandrel 12, guide piece 34 is easily accessed and rotated back into the outer sleeve installation/removal position. Then, the new tubular blanket or printing plate that is of a larger or smaller diameter than outer sleeve 16 is slid onto the new bridge sleeve while air is provided to the outer surface of the new bridge sleeve. Accordingly, a simple rotational adjustment of guide piece 34 allows the press operator to switch between the outer sleeve and bridge sleeve installation/removal positions.

In an alternative embodiment, an automatically controlled actuator may be coupled to at least one of guide piece 34 and mandrel 12 for rotating guide piece 34 based on instructions from a controller.

In the preceding specification, the invention has been described with reference to specific exemplary embodiments and examples thereof It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A printing press cylinder assembly comprising:

a mandrel including an outer surface, a passage formed therein, at least one first conduit formed therein coupled to the passage and the outer surface, and at least one second conduit formed therein coupled to the passage and the outer surface;

a guide piece located in the passage, the guide piece being movable in the passage between a first position where the guide piece guides air from the passage to the at least one first conduit and a second position where the guide piece guides air from the passage to the at least one second conduit, wherein the guide piece includes at least one first hole for guiding air to the at least one first conduit in the first position and at least one second hole for guiding air to the at least one second conduit in the second position; and a fastener for holding the guide piece in the passage, the mandrel including a slot formed therein, the fastener extending from the slot into the passage to contact the guide piece;

wherein the guide piece includes a groove formed therein, the fastener sliding in the groove as the guide piece is rotated between the first and second positions.

2. A printing press cylinder assembly comprising:

a mandrel including an outer surface, a passage formed therein, at least one first conduit formed therein coupled to the passage and the outer surface, and at least one second conduit formed therein coupled to the passage and the outer surface; and a guide piece located in the passage, the guide piece being movable in the passage between a first position where the guide piece guides air from the passage to the at least one first conduit and a second position where the guide piece guides air from the passage to the at least one second conduit, the guide piece blocking the passage from the at least one second conduit in the first position and blocking the passage from the at least one first conduit in the second position.

3. The printing press cylinder assembly recited in claim 2 further comprising a bridge sleeve slidable onto the mandrel, the bridge sleeve including at least one bridge hole formed therein aligning with the at least one second conduit.

4. The printing press cylinder assembly recited in claim 3 wherein an inner surface of the bridge sleeve covers the at least first conduit when the bridge sleeve is mounted on the mandrel.

5. The printing press cylinder assembly recited in claim 3 further comprising an outer sleeve slidable onto the bridge sleeve.

6. The printing press cylinder assembly recited in claim 5 wherein an inner surface of the outer sleeve covers the at least one bridge hole when the outer sleeve is mounted on the bridge sleeve.

7. The printing press cylinder assembly recited in claim 5 wherein the outer sleeve includes a printing plate or a printing blanket.

8. The printing press cylinder assembly recited in claim 2 further comprising an air source providing compressed air into the passage.

9. The printing press cylinder assembly recited in claim 8 wherein the air source provides air to a first axial end of the mandrel and the guide piece is located in the passage at a second axial end of the mandrel.

10. The printing press cylinder assembly recited in claim 2 wherein the at least one first conduit and the at least one second conduit are spaced apart from each other axially.

11. The printing press assembly recited in claim 2 wherein the guide piece includes at least one first hole for guiding air to the at least one first conduit in the first position and at least one second hole for guiding air to the at least one second conduit in the second position.

12. The printing press assembly recited in claim 11 wherein the at least one first hole is axially offset from the at least one first conduit in the second position and the at least one second hole is offset axially from the at least one second conduit in the first position.

13. The printing press assembly recited in claim 11 further comprising a fastener for holding the guide piece in the passage, the mandrel including a slot formed therein, the fastener extending from the slot into the passage to contact the guide piece.

14. The printing press assembly recited in claim 13 wherein the guide piece includes a groove formed therein, the fastener sliding in the groove as the guide piece is rotated between the first and second positions.

15. The printing press assembly recited in claim 14 wherein the groove includes a first axially aligned portion and a second axially aligned portion circumferentially offset from the first axially aligned portion, the fastener being in the first axially aligned portion when the guide piece is in the first position and in the second axially aligned portion when the guide piece is the second position.

16. The printing press assembly recited in claim 2 wherein the guide piece is movable between the first and second position by rotating the guide piece about a center axis thereof.

* * * * *